US005613832A

United States Patent [19]

Su

[11] Patent Number: 5,613,832

[45] Date of Patent: Mar. 25, 1997

[54] MEANS FOR ENGAGING A REMOTE CONTROL UNIT TO A CEILING FAN

[76] Inventor: Chih-hai Su, No. 72-10, Chianan Li, Shanhua Chen, Tainan Hsien, Taiwan

[21] Appl. No.: 502,554

[22] Filed: Jul. 14, 1995

[51] Int. Cl.[6] ..... F04D 29/64

[52] U.S. Cl. ..... 416/244 R; 416/5; 416/61; 248/343

[58] Field of Search ..... 416/5, 170 R, 416/244 R, 246, 61; 417/424.1, 572; 248/342, 343

[56] References Cited

U.S. PATENT DOCUMENTS

| | | | |
|---|---|---|---|
| 4,548,554 | 10/1985 | Angott | 416/5 |
| 4,729,725 | 3/1988 | Markwardt | 416/244 R |
| 4,884,947 | 12/1989 | Rezek | 416/5 |
| 5,340,277 | 8/1994 | Whitaker | 416/5 |

*Primary Examiner*—Edward K. Look
*Assistant Examiner*—Christopher Verdier
*Attorney, Agent, or Firm*—Parkhurst, Wendel & Burr, L.L.P.

[57] ABSTRACT

A device for engaging a remote control unit to a ceiling fan which has a motor for mechanically actuating blades connected thereto and a rod with a head which extends upwardly from the motor, a fixing element fixedly engaged to the floor and having a C-shaped portion for engagement with the head of the rod, a middle plate having a central hole for the rod to extend therethrough and having at least two sockets extending from an underside thereof, the middle plate received in a bowl which has a hole for the rod to extend therethrough and at least two studs extending from a bottom thereof for engagement with the sockets, electrical elements for remote controlling the ceiling fan disposed in the bowl which is engaged to the fixing element by bolts such that the remote control unit can be repaired simply by disengaging the bowl from the fixing element.

3 Claims, 6 Drawing Sheets

MEANS FOR ENGAGING A REMOTE CONTROL UNIT TO A CEILING FAN

BACKGROUND OF THE INVENTION

1. Field of Invention

The present invention relates to a means for engaging a remote control unit to a ceiling fan such that the remote control unit can be repaired without disengaging the ceiling fan.

2. Related Prior Art

FIGS. 1 and 2 show a conventional ceiling fan 58 with a remote control unit 60 installed therewith. Generally, the conventional ceiling fan 58 includes a motor 581 to which a plurality of blades 582 are connected, a rod 55 extending upwardly from the motor 581 and a fixing element 50 which has a C-shaped portion 51. The rod 55 has a distal end with a head portion 56 formed thereto which has a larger diameter than that of the rod 55 such that the head portion 56 is engaged to the C-shaped portion 51 of the fixing element 50. The fixing element 50 has two extensions 52 extending diametrically opposite from the C-shaped portion 51, each extension 52 has a plate portion 53 extending radially therefrom, each plate portion 53 has a slot 54 defined therein and has a plurality of holes 531 defined in an outer periphery of the plate portion 53 and a plurality of holes 511 defined in an under side of the C-shaped portion 51. A remote unit 60 is a disk type element which has electrical elements disposed therein, the remote unit 60 and the fixing element 50 are engaged to the ceiling 70 by extending bolts through slots 54 of the fixing element 50 and holes 61 defined in the remote unit 60 and threadedly engaged to the ceiling 70. A bowl 57 has a central hole 572 defined therein for the rod 55 to extend therethrough, the bowl 57 has a plurality of holes 571 and holes 573 respectively defined in a periphery thereof and an under side thereof such that the bowl 57 is engaged to the fixing element 50 by threading bolts through the holes 573, 511 or 571, 531. However, when the remote unit 60 needs to be repaired or to be replaced, the repairman must disengage the bowl 57, the ceiling fan 58, the fixing element 50 and the remote unit 60 then he can proceed with the repair. This is deemed to include too many processes and incur excessive cost.

The present invention intends to provide a means for engaging a remote control unit to a ceiling fan which is engaged to the fixing element and the remote control unit is disposed beneath the fixing element which can be repaired simply by disengaging the bowl from the fixing element so as to mitigate and/or obviate the above-mentioned problems.

SUMMARY OF THE INVENTION

The present invention provides a means for engaging a remote control unit to a ceiling fan which has a motor for mechanically actuating blades connected thereto and a rod with a head which extends upwardly from the motor, A fixing element is fixedly engaged to the floor and has a C-shaped portion for engagement with the head of the rod, a middle plate having a central hole for the rod to extend therethrough and having two sockets extending from an under side thereof. The middle plate is received in a bowl which has a hole for the rod to extend therethrough and two studs extend from a bottom thereof for engagement with the sockets. Electrical elements for remote controlling the ceiling fan are disposed in the bowl which is engaged to the fixing element by bolts.

It is an object of the present invention to provide a means for engaging the remote control unit to the ceiling fan to enable the unit to be repaired without disengaging the ceiling fan from the fixing element.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
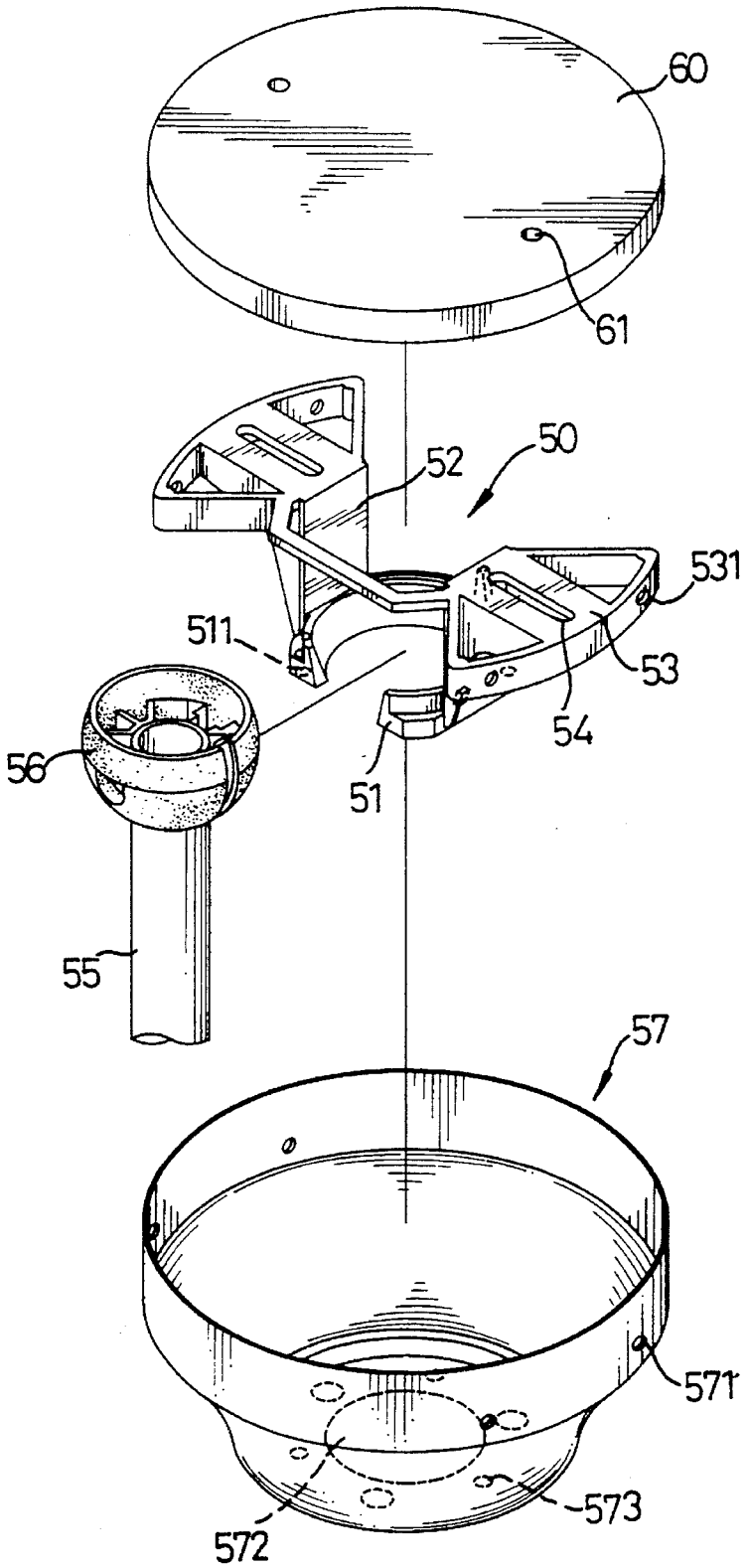
FIG. 1 PRIOR ART
FIG. 1 is an exploded view of a conventional remote control unit and the fixing element and the bowl for engaging the ceiling fan to the ceiling.
Figure 2:
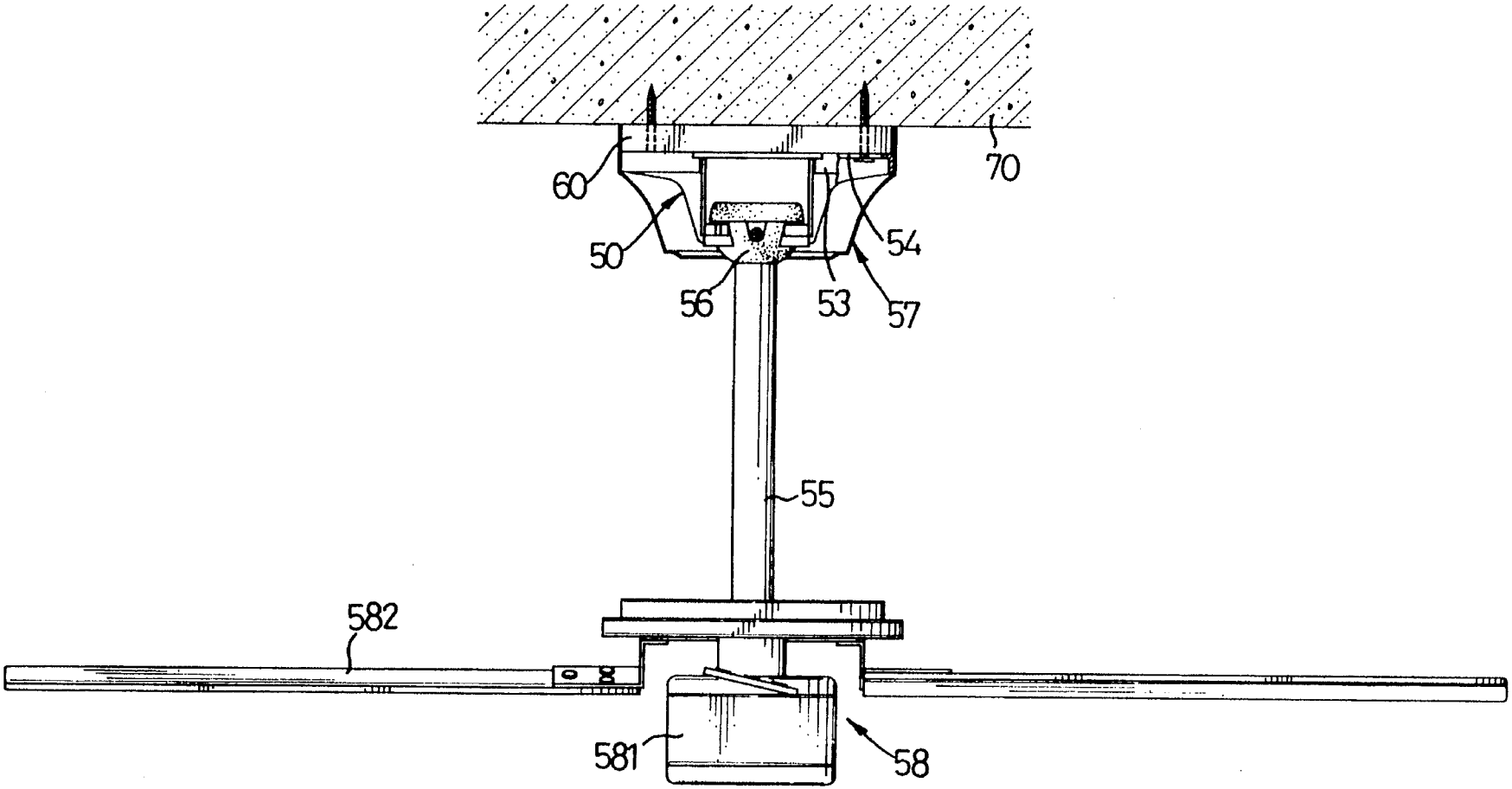
FIG. 2 PRIOR ART
FIG. 2 is a side elevational view, partly in section, of the engagement between the ceiling fan and the conventional remote control unit.
Figure 3:
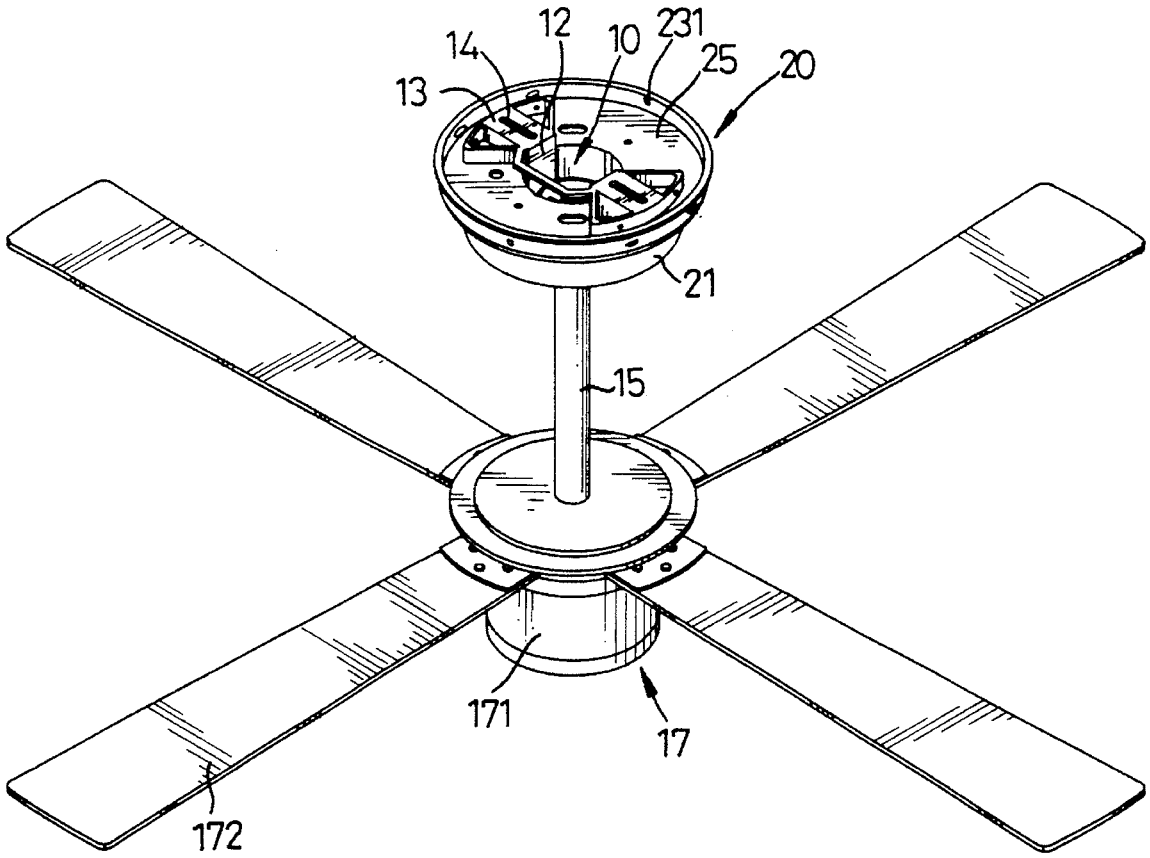
FIG. 3 is a perspective view of a ceiling fan having a means for engaging a remote control unit thereto in accordance with the present invention.
Figure 4:
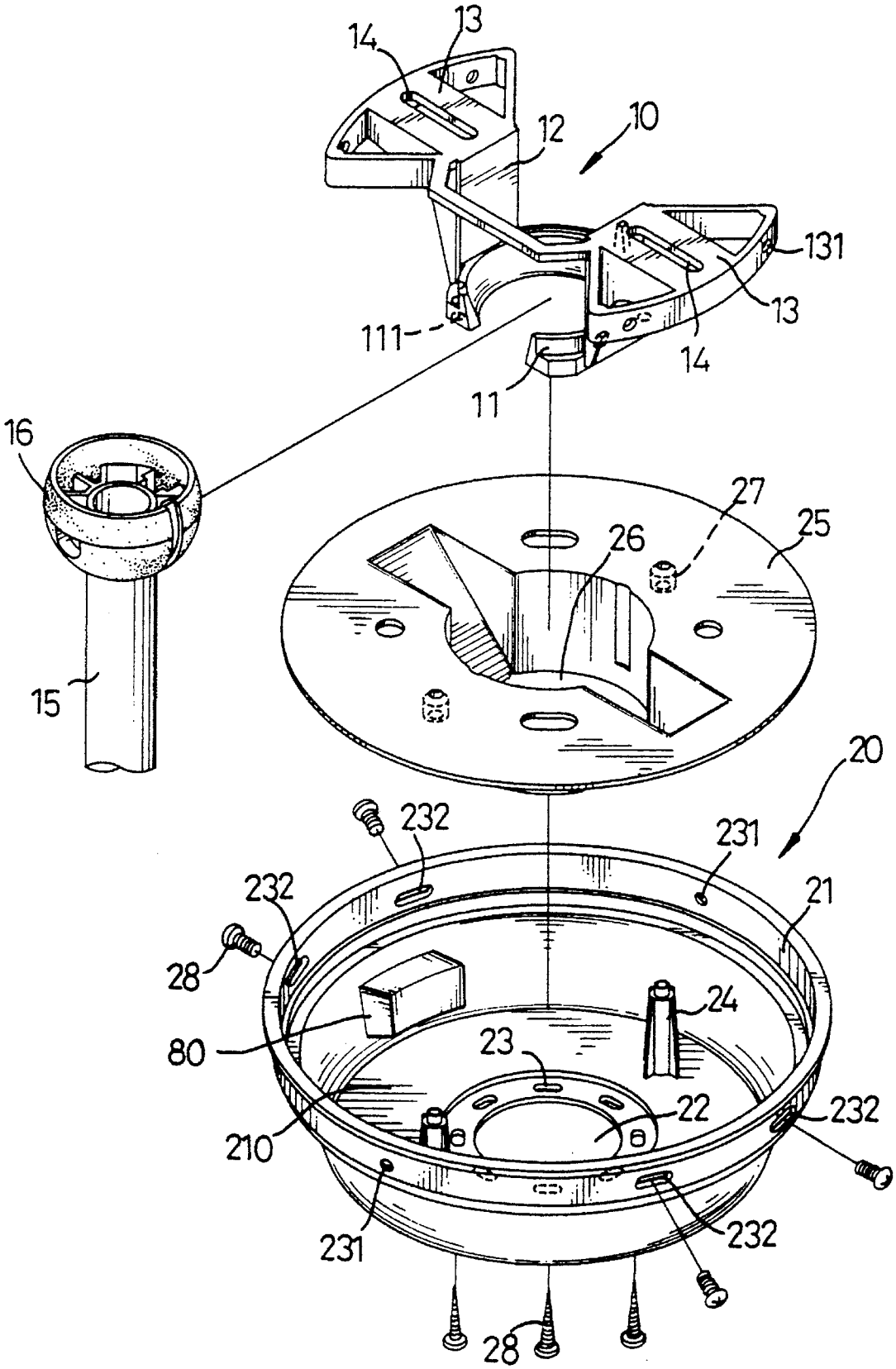
FIG. 4 is an exploded view of the means in accordance with the present invention.
Figure 5:
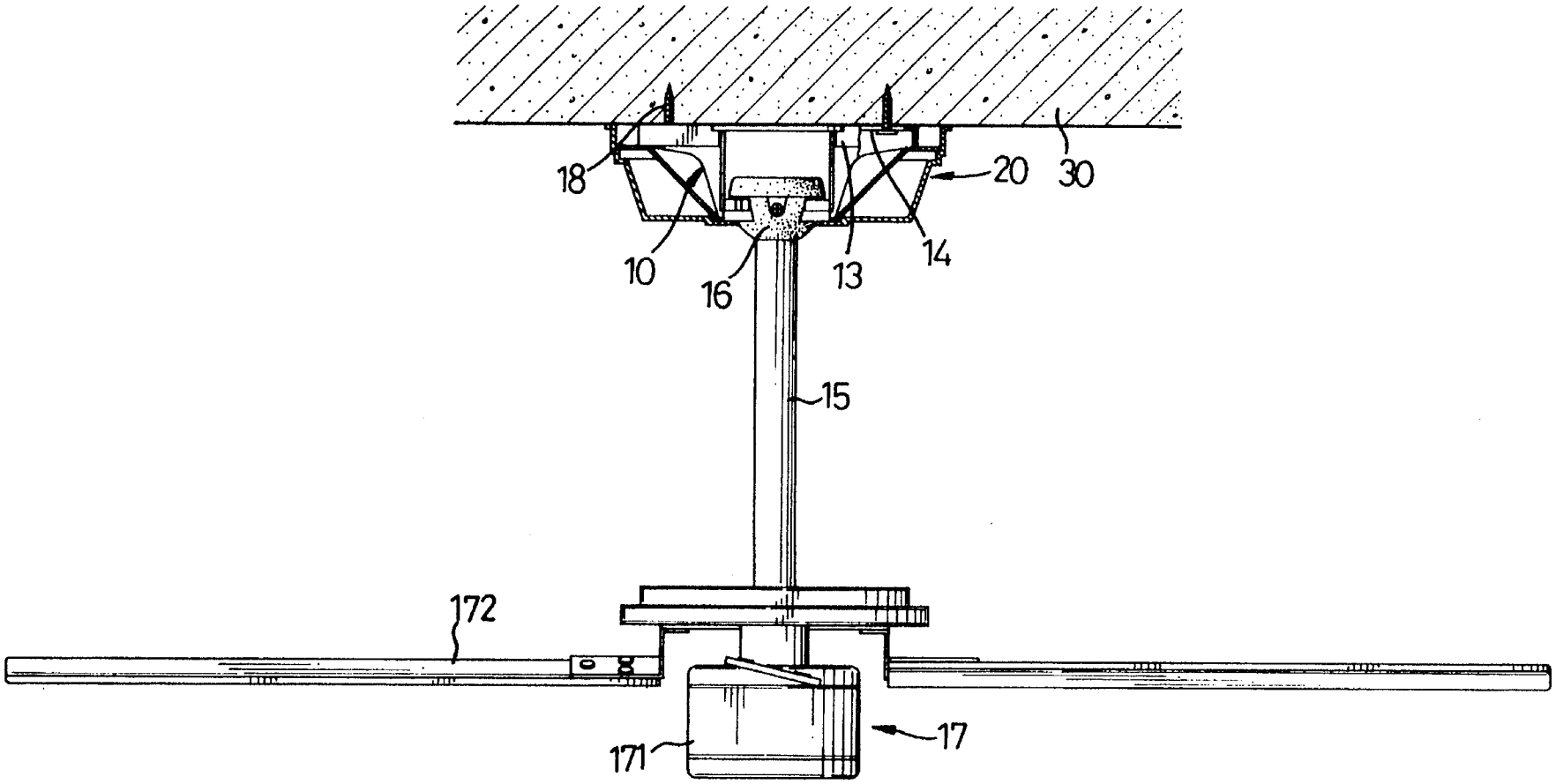
FIG. 5 is a side elevational view, partly in section, of the ceiling fan with the means shown in FIG. 2 disposed thereto in accordance with the present invention.

Referring to the drawings and initially to FIGS. 3 through 5, a ceiling fan 17 comprises a motor 171 and a plurality of blades 172 which are mechanically connected to the motor 171, the motor 171 having a rod 15 extending upwardly therefrom which has a distal end with a head portion 16 formed thereto.

A fixing element 10 has a C-shaped portion 11 which has an inner diameter smaller than a diameter of the head portion 16 such that the head portion 16 is engaged with the C-shaped portion 11, two extensions 12 diametrically opposite extending upwardly from the C-shaped portion 11 and each of the extensions 12 having a plate 13 extending radially therefrom which has a slot 14 defined therein and has a plurality of first threaded holes 131 defined in an outer periphery thereof, a plurality of second threaded holes 111 defined in an underside of the C-shaped portion 11.

A middle plate 25 has a central hole 20 defined therein for the rod 15 of the motor 171 to extend therethrough and has at least two sockets 27 extending from an underside thereof.

A bowl 20 has a bottom 210 and a skirt portion 21, the bottom 210 having a hole 22 defined centrally therein for the rod 15 to extend therethrough and a plurality of second elongated holes 23 defined therein corresponding to the second threaded holes 111 of the fixing element 10, at least two studs 24 extending upwardly from the bottom 210 for engagement with the sockets 27, a plurality of first elongated holes 232 defined in the skirt portion 21 corresponding to the first threaded holes 131 of the fixing element 10. The fixing element 10 is fixedly engaged to a ceiling 30 by threading screws 18 therein by extending through the corresponding slots 14. Electrical elements 80 for remote controlling the ceiling fan 17 are disposed in the bowl 20 which is made of transparent material and the bowl 20 is engaged to the fixing element 10 by bolts 28 extending through the first elongated holes 232 and the second elongated holes 23 and threadedly engaging to the second threaded holes 131 and the second threaded holes 111 respectively of the fixing element 10.

Accordingly, when the remote control unit needs to be repaired, the repairman simply disengages bolts 28 from the bowl 20 and the fixing element 10 and needs not disengage the ceiling fan 17 from the fixing element 10 then he/she may proceed with the repair.

Figure 6:
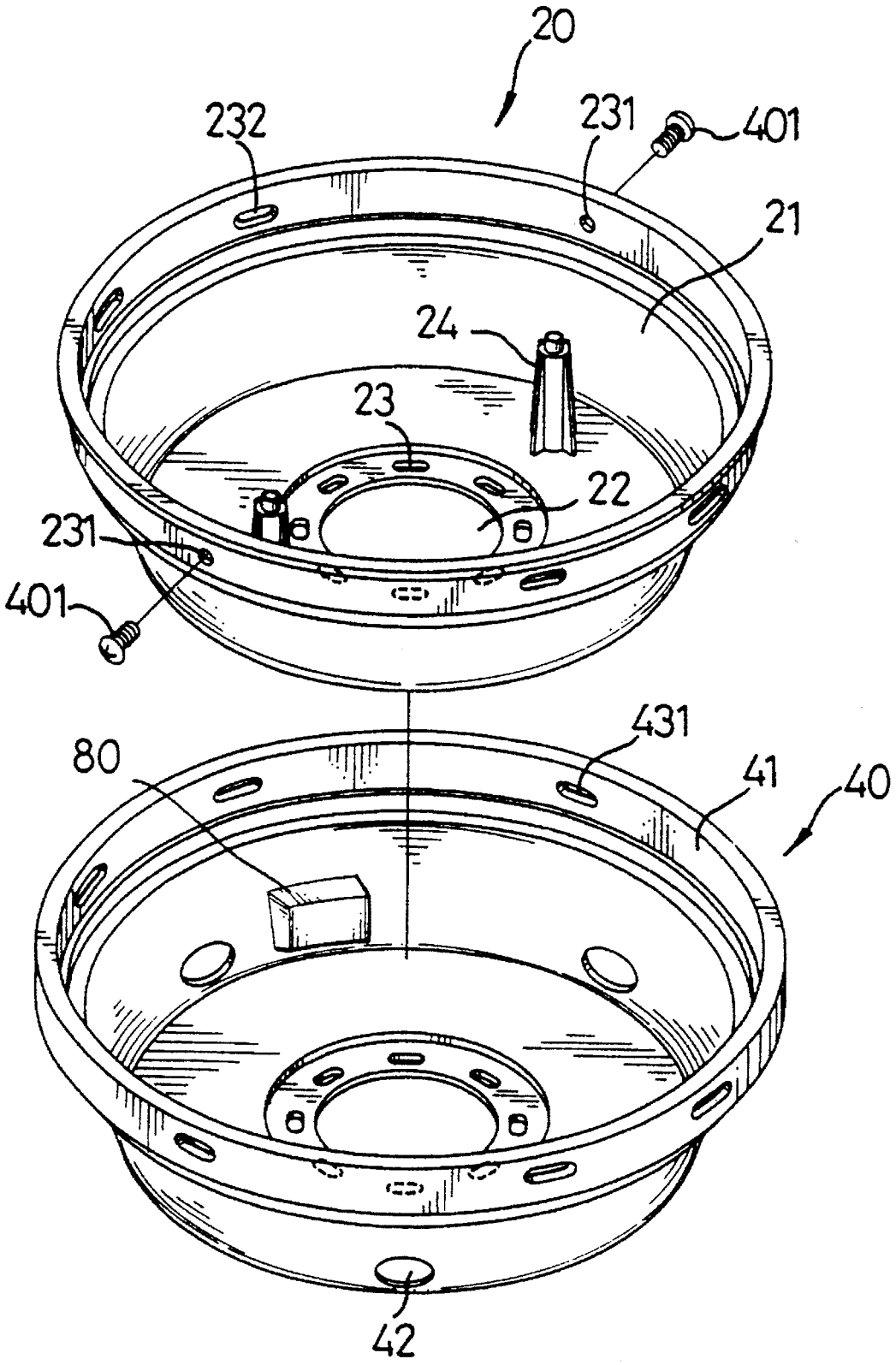
FIG. 6 is an exploded view of an opaque cover and the bowl in accordance with the present invention.

Furthermore, referring to FIG. 6, the skirt portion 21 has two third threaded holes 231 defined therein and a colored cover 40 has the same shape and the same structure as those of the bowl 20 and can be disposed to the bowl 20 by bolts 401 threadedly engaging to the third threaded holes 231 via corresponding elongated holes 431 defined in a skirt portion 41 of the colored cover 40, wherein the colored cover 40 has several holes 42 defined therein for an electrical wave transmitted to the electrical elements to be received in the bowl 20 via the holes 42, such that the bowl 20 may have a certain color for a decorative purpose.

Although the invention has been explained in relation to its preferred embodiment, it is to be understood that many other possible modifications and variations can be made without departing from the spirit and scope of the invention as hereinafter claimed.

I claim:

1. A means for engaging a remote control unit to a ceiling fan, said ceiling fan comprising a motor and a plurality of blades which are mechanically connected to said motor, said motor having a rod extending upwardly therefrom which has a head portion formed thereto, said means for engaging a remote control unit comprising:

a fixing element having a C-shaped portion which has an inner diameter smaller than a diameter of said head portion such that said head portion is engaged with said C-shaped portion, two extensions diametrically opposite extending upwardly from said C-shaped portion and each of said extensions having a plate extending radially therefrom which has a slot defined therein and has a plurality of first threaded holes defined in an outer periphery thereof, a plurality of second threaded holes defined in an underside of said C-shaped portion;

a middle plate having a central hole defined therein for said rod of said motor to extend therethrough and having at least two sockets extending from an underside thereof; and a bowl having a bottom and a skirt portion, said bottom having a hole defined centrally therein for said rod to extend therethrough and a plurality of second holes defined therein corresponding to said second threaded holes of said fixing element, at least two studs extending upwardly from said bottom for engagement with said sockets, a plurality of first holes defined in said skirt portion corresponding to said first threaded holes of said fixing element, electrical elements for remote controlling said ceiling fan disposed in said bowl and said bowl engaged to said fixing element by bolts extending through said first and said second holes and threadedly engaged to said first threaded holes and said second threaded holes of said fixing element, respectively.

2. The remote control unit as claimed in claim 1, wherein said first holes and said second holes are elongated holes.

3. The remote control unit as claimed in claim 1, wherein said bowl is made of transparent material.

* * * * *